US008804466B2

(12) United States Patent
Matsuzaki

(10) Patent No.: US 8,804,466 B2
(45) **Date of Patent: *Aug. 12, 2014**

(54) ELECTRONIC TIMEPIECE

(75) Inventor: Jun Matsuzaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 147 days.

This patent is subject to a terminal disclaimer.

(21) Appl. No.: 13/172,462

(22) Filed: Jun. 29, 2011

(65) Prior Publication Data

US 2012/0002512 A1 Jan. 5, 2012

(30) Foreign Application Priority Data

Jul. 5, 2010 (JP) ..... 2010-152596

(51) Int. Cl.
*G04B 37/12* (2006.01)

(52) U.S. Cl.
USPC ..... 368/47; 368/278

(58) Field of Classification Search
USPC ..... 368/278–280, 203–205, 47
See application file for complete search history.

(56) References Cited

U.S. PATENT DOCUMENTS 7,889,085 B2 * 2/2011 Downey et al. ..... 340/573.1
8,467,272 B2 * 6/2013 Fujisawa ..... 368/47
8,493,817 B2 * 7/2013 Baba ..... 368/47
2009/0251997 A1 * 10/2009 Kimura ..... 368/47
2010/0097896 A1 4/2010 Baba
2011/0051561 A1 * 3/2011 Fujisawa ..... 368/47
2012/0002511 A1 1/2012 Matsuzaki

FOREIGN PATENT DOCUMENTS

| | | |
|---|---|---|
| CN | 102314150 | 1/2012 |
| EP | 2177962 A2 | 4/2010 |
| JP | 10-197662 | 7/1998 |
| JP | 2000-147169 | 5/2000 |
| JP | 2001-027680 | 1/2001 |
| JP | 2010-096707 | 4/2010 |

OTHER PUBLICATIONS

The extended European search report for Application No. 11172342.5 dated Dec. 28, 2011.
NPL—European Search Report dated Dec. 28, 2011, Application No. 11172343.3-1240.

* cited by examiner

*Primary Examiner* — Sean Kayes

(57) ABSTRACT

An electronic timepiece that receives signals and displays information can be driven using solar power while suppressing antenna sensitivity loss to a sufficiently low level. An electronic timepiece has a dial, on the face of which time is displayed, a flat antenna, and a solar cell. The flat antenna is disposed in an area on the back side of the dial, extends in the plane direction of the dial, and receives signals passing through the dial. The solar cell is also disposed in the area on the back side of the dial, positioned vertically between the dial and the flat antenna. The solar cell also extends in the plane direction of the dial.

7 Claims, 4 Drawing Sheets

ELECTRONIC TIMEPIECE

This application claims priority under 35 U.S.C. §119 to Japanese Patent Application No. 2010-152596 filed on Jul. 5, 2010, the entire disclosure of which is expressly incorporated by reference herein.

BACKGROUND

1. Technical Field

The present invention relates to an electronic timepiece that receives signals transmitted from GPS satellites or other positioning information satellites and displays information.

2. Related Art

The Global Positioning System (GPS) uses GPS satellites (positioning information satellites) that orbit the Earth on known orbits and enables a GPS receiver (GPS device) to determine its own location from these GPS signals. Each GPS satellite carries an atomic clock, and transmits satellite signals that contain time information (GPS time information) expressing the time (GPS time) that is kept by the atomic clock. The GPS time is the same on all GPS satellites, and UTC (Coordinated Universal Time) is determined by correcting the GPS time with the UTC offset (currently +15 seconds), which is the difference between GPS time and UTC. UTC can therefore be determined by receiving a satellite signal from a GPS satellite and acquiring the GPS time, and then correcting the GPS time based on the UTC offset.

Japanese Unexamined Patent Appl. Pub. JP-A-H 10-197662 teaches an electronic timepiece ("GPS timepiece" below) that receives satellite signals from GPS satellites and obtains the current time. A stacked construction that has the antenna for receiving satellite signals and the dial for displaying the time on the surface one above the other is desirable as a means of reducing the size of the GPS timepiece, but if the antenna is disposed on the face side of the dial, the part of the dial where the antenna is located cannot be used for a functional display (such as displaying the date). JP-A-H 10-197662 therefore teaches a configuration having the antenna located behind the dial.

With the development of efficient, low power consumption GPS reception circuits, solar power can now be used to meet the power supply needs of an electronic timepiece that obtains the current time by receiving and processing satellite signals from GPS satellites. More specifically, GPS timepieces that have a solar cell for converting light energy to electrical energy to power the timepiece are now possible. Depending on the location of the solar cell, however, antenna sensitivity can be significantly degraded. For example, if a solar cell is added to the timepiece taught in JP-A-H 10-197662, the solar cell will naturally be added between the dial and the antenna, covering the antenna. However, solar cells contain metal materials, and microwaves such as those that carry satellite signals are easily affected by metal. Antenna sensitivity therefore drops dramatically if the antenna is covered by the solar cell.

SUMMARY

An electronic timepiece according to the present invention that receives RF signals and displays information can be driven by solar power while suppressing loss of antenna sensitivity to a sufficiently low level.

A first aspect of the invention is an electronic timepiece that receives radio frequency signals and displays information, including: a dial on the front of which time is displayed; a flat antenna that is disposed on the back side of the dial superimposed on the dial in a vertical direction perpendicular to the dial, extends in the plane direction of the dial, and receives the signals passing through the dial; and a photovoltaic device that is disposed vertically between the dial and the flat antenna, and extends in the same plane direction. The flat antenna is square in the plane direction, and the shortest distance in the plane direction between the flat antenna and the photovoltaic device is at least 0.2 times the side length of the flat antenna.

The photovoltaic device has a strong radio frequency shield effect because it contains metallic materials, but antenna sensitivity loss is sufficiently suppressed in the electronic timepiece according to this aspect of the invention because the photovoltaic device, which is disposed between the dial and the flat antenna, does not overlap the flat antenna vertically, and the flat antenna and photovoltaic device are sufficiently separated from each other in the plane direction of the dial. More specifically, an electronic timepiece that receives RF signals and displays information according to the invention can operate using solar power while suppressing loss of antenna sensitivity to a sufficiently low level.

Because frequencies above 300 MHz, such as frequencies in the ultrahigh frequency band (microwave signals), are easily affected by metal, suppressing loss of antenna sensitivity is particularly important when receiving signals with a frequency of 300 MHz or greater. In order to further suppress loss of antenna sensitivity, the shortest distance between the flat antenna and photovoltaic device is further preferably at least 0.5 times the length of one side of the flat antenna.

A microstrip antenna that can receive polarized waves is preferably used as the flat antenna. A microstrip antenna, for example, can receive circularly polarized waves from GPS satellites.

In another aspect of the invention, the gap between the flat antenna and the photovoltaic device in the vertical direction is preferably less than or equal to 0.1 times the thickness of the flat antenna.

In an electronic timepiece according to another aspect of the invention, the photovoltaic device has a through-hole in which the flat antenna is contained in the plane direction; and the shape of the flat antenna in the plane direction and the shape of the through-hole in the plane direction are similar to each other. This configuration can maximize the light-receiving surface area (generating capacity) of the photovoltaic device.

An electronic timepiece according to another aspect of the invention preferably also has a case that has a wall surrounding a space in the plane direction and houses the dial, the flat antenna, and the photovoltaic device in this space. In addition, the photovoltaic device has a through-hole in which the flat antenna is contained in the plane direction, and the side of the through-hole with the shortest distance to the wall in the plane direction is longer than any other side.

An electronic timepiece according to another aspect of the invention preferably also has a metal case that has a wall surrounding a space in the plane direction, and houses the dial, the flat antenna, and the photovoltaic device in this space. In addition, the wall has a top surface on the front side and a bottom surface on the back side, and the flat antenna and the case are disposed so that a side distance between a side of the flat antenna and the wall in the plane direction is greater than or equal to one time and less than or equal to two times the vertical distance between the top surface of the wall and the flat antenna.

This aspect of the invention achieves the same effects described above while using a case that is made of metal. Note that "made of metal" as used herein means that metallic materials are included. A "metal case" is therefore not limited to cases that are made of only metal, and includes cases that are made of metallic materials and non-metallic materials.

Note, further, that "side distance" as used herein is the shortest distance in the plane direction of the dial between the side of the flat antenna and the wall.

The "distance between a side and the wall" is the plane distance, and is the shortest distance between the wall and the side in the direction perpendicular to the side.

Wristwatches are typically worn on the wrist. Therefore, if the electronic timepiece is a wristwatch, signals from the 6:00 direction are more likely to be blocked by the body than signals form the 12:00 direction. For example, when the user bends the left arm on which the wristwatch is worn to see the face (front) of the dial, the user's body is located in the 6:00 direction of the face, and signals from the 6:00 direction are easily blocked by the user's body. A configuration that can receive signals from the 12:00 direction more easily than from the 6:00 direction is therefore preferable so that the actual sensitivity of the flat antenna remains high. This can be achieved by, for example, disposing the flat antenna in a peripheral part of the space corresponding to the 6:00 position on the front (face), thereby creating more space on the 12:00 side.

Wristwatches are also commonly worn on the left wrist. Therefore, when the electronic timepiece is a wristwatch, signals from the 9:00 direction are more likely to be obstructed by the body than signals from the 3:00 direction. For example, when the user bends the left arm on which the wristwatch is worn to see the face (front) of the dial, the user's left shoulder is located in the 9:00 direction of the face, and signals from the 9:00 direction are easily blocked by the left shoulder or other body part. A configuration that can receive signals from the 3:00 direction more easily than from the 9:00 direction is therefore preferable so that the actual sensitivity of the flat antenna remains high. This can be achieved by, for example, disposing the flat antenna in a peripheral part of the space corresponding to the 9:00 position on the front (face), thereby creating more space on the 3:00 side.

In an electronic timepiece according to another aspect of the invention, the signals are satellite signals transmitted from positioning information satellites; and the electronic timepiece includes a time acquisition unit that acquires the time based on the satellite signals.

GPS satellites are an example of a positioning information satellite. Because accurate time information (GPS time information) is contained in the satellite signals from GPS satellites, the accurate time can be acquired based on the satellite signals.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures. Note that the sizes and scale of parts shown in the figures differ as needed from the actual. A preferred embodiment of the invention is described below with certain technically desirable limitations, but the scope of the invention is not limited thereto unless such limitation is expressly stated below. The embodiment described below, embodiments that can be achieved by varying the following embodiment, and desirable combinations thereof are also included in the scope of the invention.

Figure 1:
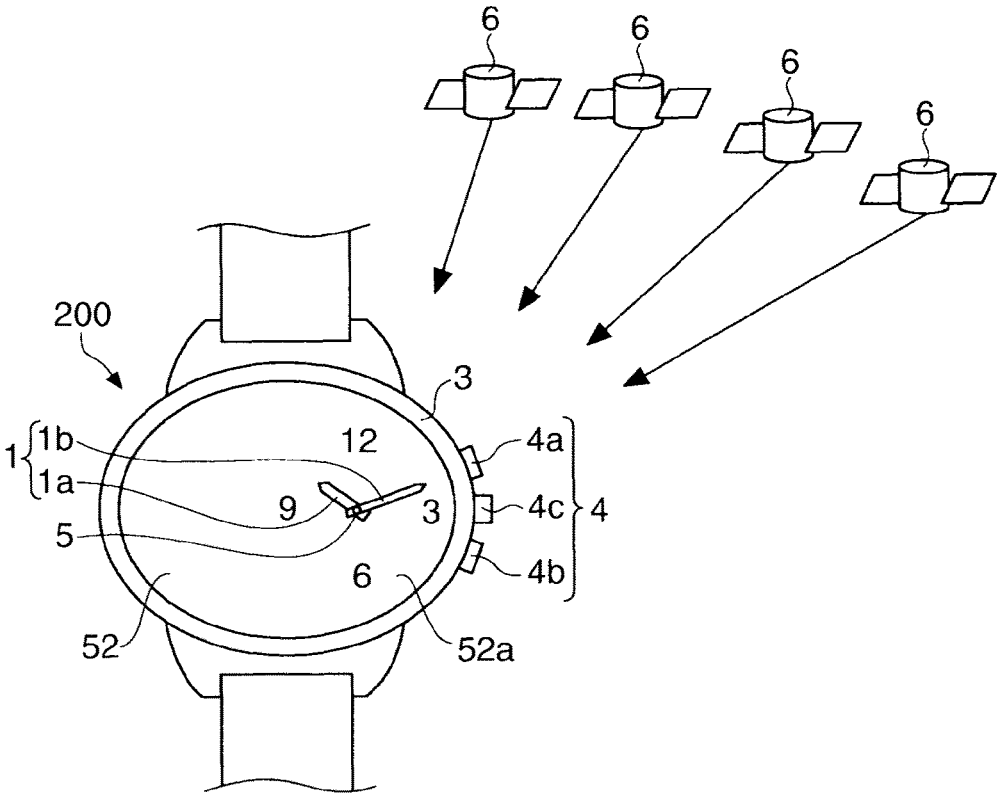
FIG. 1 shows the appearance of an electronic timepiece 200 according to a preferred embodiment of the invention.

FIG. 1 shows an electronic timepiece 200 according to this embodiment of the invention. As will be understood from the figures, the electronic timepiece 200 is a wristwatch that keeps and displays time, and includes a dial 52, hands 1 disposed on the face 52*a* side of the dial 52, and a case 3 that houses the dial 52. The dial 52 is made from a non-metallic material (such as plastic) that passes light and microwave signals. The hands 1 include an hour hand 1*a* and a minute hand 1*b* that rotate on a staff 5 passing through the dial 52, and display time on the face 52*a* of the dial 52 according to the rotational positions of the hands. The hands 1 may also include a second hand.

Numbers indicating rotational positions are drawn on the face 52*a* of the dial 52. Of these numbers, 3 is at the 3:00 o'clock position, 6 is at the 6:00 position, 9 at the 9:00 position, and 12 at the 12:00 position. Note that herein the direction on the dial 52 from the staff 5 to the 3:00 position is referred to as the 3:00 direction, the direction from the staff 5 to the 6:00 position is referred to as the 6:00 direction, the direction from the staff 5 to the 9:00 position is referred to as the 9:00 direction, and the direction from the staff 5 to the 12:00 position is referred to as the 12:00 direction.

The time that is kept internally by the electronic timepiece 200 is referred to below as the "internal time," and the time displayed on the face 52*a* of the dial 52 is referred to as the "display time." The internal time is UTC and the display time is the local time, but the invention is not so limited. For example, the internal time could be a time other than UTC, the display time could be a time other than the local time, and the internal time and the display time may be the same.

The electronic timepiece 200 is designed to be worn on the left wrist, and an operating unit 4 that is manipulated by the operator is disposed on the right side of the case 3 (in the 3:00 direction). The operating unit 4 includes buttons 4*a* and 4*b*, and a crown 4*c*. Both buttons 4*a* and 4*b* and the crown 4*c* output operation signals according to the particular operation performed.

The electronic timepiece 200 can receive satellite signals (1.57542-GHz microwave signals (L1 frequency signals) with a superimposed navigation message) from a plurality of GPS satellites 6 orbiting the Earth on known orbits. Each GPS satellite 6 has an on-board atomic clock to keep time, and orbit information indicating the position of the GPS satellite 6 on its orbit, and time information (GPS time information) identifying the extremely accurate time (GPS time) that is kept by the atomic clock, are contained in the satellite signals.

The electronic timepiece 200 corrects the internal time (adjusts error) based on satellite signals from at least one GPS satellite 6, determines its current location based on satellite signals from at least four GPS satellites 6, and corrects the display time (adjusts error) based on the time difference identified from the current location and satellite signals from at least one GPS satellite 6.

Figure 2:
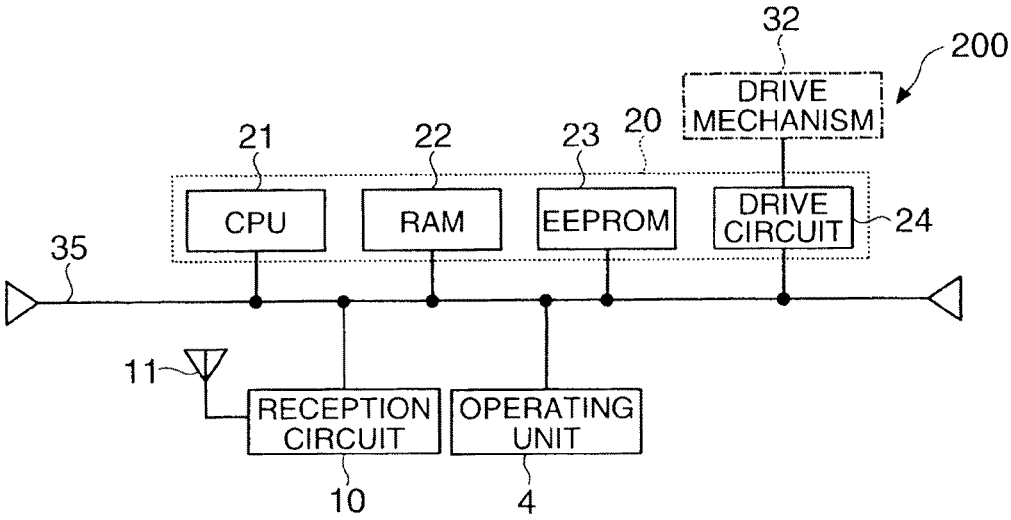
FIG. 2 is a block diagram showing the circuit configuration of the electronic timepiece 200.

FIG. 2 is a block diagram showing the circuit configuration of the electronic timepiece 200. As shown in FIG. 2, the electronic timepiece 200 has a reception circuit 10, a flat antenna 11, a control unit 20, and a battery (battery 44 described below) not shown in addition to the operating unit 4.

The control unit 20 includes a CPU (central processing unit) 21, RAM (Random Access Memory) 22, EEPROM (Electrically Erasable and Programmable Read Only Memory) 23, and a drive circuit 24. The reception circuit 10, operating unit 4, CPU 21, RAM 22, EEPROM 23, and drive circuit 24 are connected to a data bus 35.

The flat antenna 11 is a microstrip antenna (patch antenna) that receives (circularly polarized) RF signals in the ultrahigh frequency band (300 MHz-3 GHz). The reception circuit 10 is a common GPS reception module and receives satellite signals through the flat antenna 11. More specifically, the reception circuit 10 processes satellite signals output from the flat antenna 11, acquires orbit information and GPS time information, and generates and outputs time information indicating the GPS time based on the acquired information. When satellite signals are received from at least four GPS satellites 6 in a specified time, the reception circuit 10 generates and outputs positioning information identifying the current location based on the acquired information.

The drive circuit 24 is controlled by the CPU 21, and supplies drive signals to the drive mechanism 32 that drives the hands 1. The drive mechanism 32 includes a stepper motor and wheel train driven by drive signals supplied from the drive circuit 24, and drives the hands 1 through the intervening staff 5.

Programs executed by the CPU 21 and the UTC offset are stored in EEPROM 23. Time difference data indicating the time difference to UTC correlated to time zone information is also stored in EEPROM 23.

Internal time information denoting the internal time, and current time difference data denoting the current time difference, are stored in RAM 22.

The CPU 21 keeps the internal time, displays the display time, adjusts for error, and adjusts for time differences by running programs stored in EEPROM 23 using RAM 22 as working memory. When keeping the internal time, the CPU 21 updates the internal time information based on a clock signal from a crystal oscillator not shown. To display the display time, the CPU 21 acquires the display time (local time) based on the internal time information and the current time difference data when one or both the internal time information and the current time difference data is updated, and controls the drive circuit 24 so that the display time is displayed.

When time information is output from the reception circuit 10, the CPU 21 acquires UTC based on this time information and the UTC offset, and updates the internal time information to reflect the acquired UTC to adjust for error. Error may be adjusted intermittently at a predetermined time interval (such as one day), for example, or when a specific operation (a first operation) is performed using the operating unit 4. Note that a configuration that acquires the UTC offset from the received satellite signals is also conceivable.

To adjust the time difference, the CPU 21 sets the time difference data for the region to which the location identified by the positioning information belongs as the current time difference data when error is corrected and when positioning information is output from the reception circuit 10. The time difference is adjusted when a specific operation (a second operation) is performed using the operating unit 4. The first operation and the second operation are different from each other.

As will be known from the above, the reception circuit 10 and CPU 21 function as a time acquisition unit that determines the time based on satellite signals from GPS satellites 6.

Figures 3A, 3B:
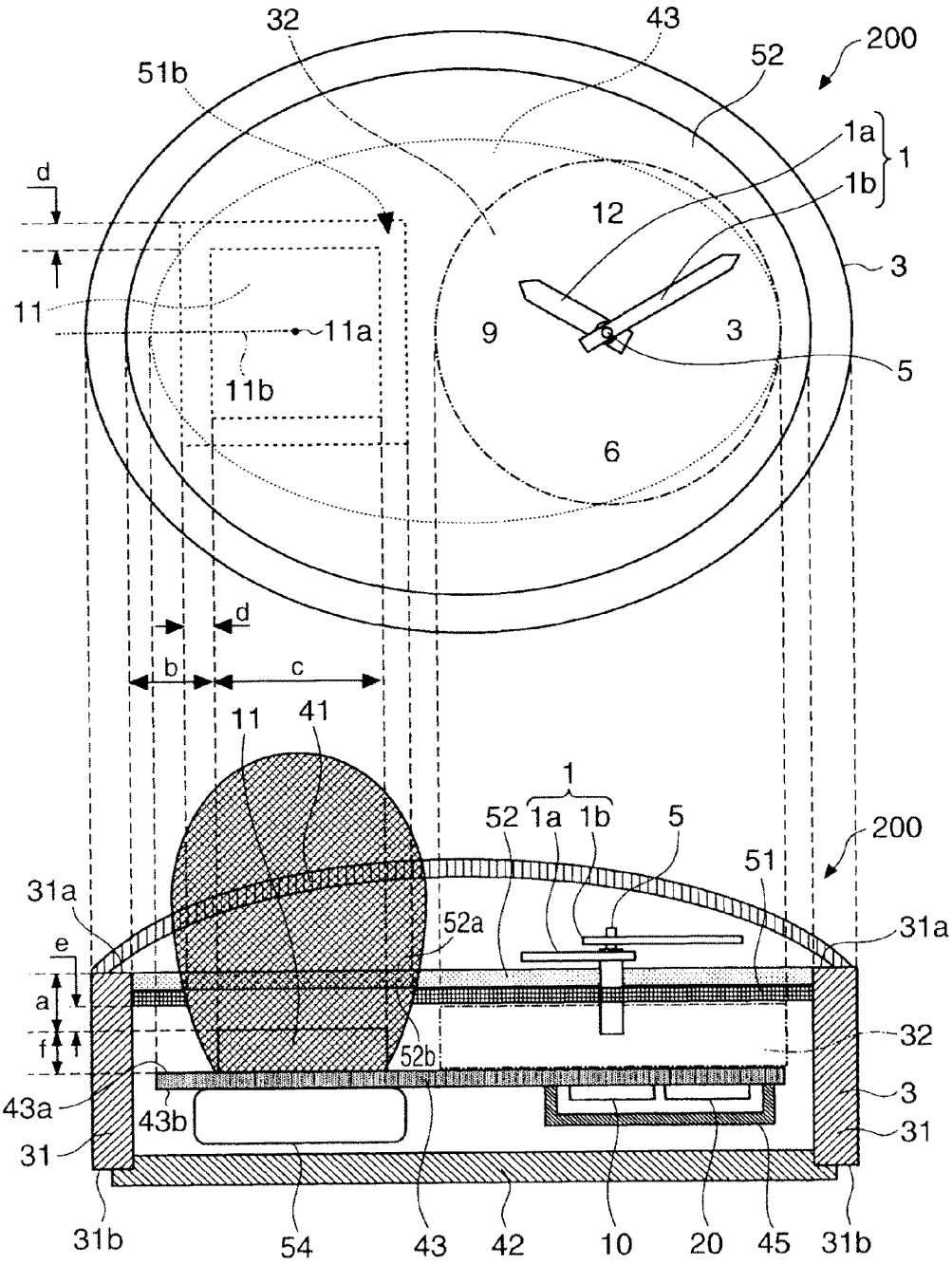
FIG. 3 shows the construction of the electronic timepiece 200 in part.

FIG. 3 shows the construction of the electronic timepiece 200 in part, FIG. 3A being a plan view and FIG. 3B being a partial section view. The case 3 is plastic and cylindrically shaped as shown in FIG. 3, and the axis of the case 3 is perpendicular to the dial 2.

The dial 52 has a face 52*a* and a back 52*b*. Of the two openings to the case 3, a crystal 41 is disposed to the opening on the face 52*a* side, and a back cover 42 is disposed to the opening on the back 52*b* side. More specifically, the case 3 has a wall 31 that surrounds a storage space defined by the case 3, crystal 41, and back cover 42 in the plane direction of the dial 52. The wall 31 rises from the periphery of the back cover 42 to the periphery of the crystal 41, and has a top surface 31*a* on the crystal 41 side and a bottom surface 31*b* on the back cover 42 side. Parts including the dial 52 and the flat antenna 11 are housed in this storage space.

A circuit board 43 is disposed in this storage space on the back 52*b* side of the dial 52. The circuit board 43 extends in the same direction as the dial 52, and has a top side 43*a* on the dial 2 side and a bottom side 43*b* on the back cover 42 side. The flat antenna 11 and drive mechanism 32 are disposed on the top side 43*a*, and the reception circuit 10, control unit 20, and a storage battery 54 are disposed on the bottom side 43*b*. Information cannot be displayed on part of the face 52*a* when the flat antenna 11 is disposed on the face 52*a* side of the dial 52, but this problem is avoided in this electronic timepiece 200 because the flat antenna 11 is disposed on the back 52*b* side of the dial 52.

The flat antenna 11 extends in the same direction as the dial 52, and the shape of the flat antenna 11 in this direction is a square with four sides. The reception circuit 10 and control unit 20 are covered by a shield plate 45, and the drive mechanism 32, reception circuit 10, and control unit 20 are driven by power supplied from the storage battery 54. In the direction perpendicular to the dial 52 (referred to herein as the vertical direction), the drive mechanism 32 is superimposed on the hands 1, all of the shield plate 45 is superimposed on the drive mechanism 32, and the flat antenna 11 is not superimposed on the drive mechanism 32.

The solar cell 51 is disposed between the dial 52 and the circuit board 43 in this vertical direction. The solar cell 51 is a photovoltaic device that converts light energy to electrical energy, extends in the same direction as the dial 52, and has a through-hole 51*a* through which the staff 5 passes (see FIG. 4), and a through-hole 51*b* through which microwave signals pass.

The dial 52, solar cell 51, drive mechanism 32, and circuit board 43 may be installed as desired, but in this embodiment of the invention a module having the circuit board 43, solar cell 51, and dial 52 fastened to the drive mechanism 32 is installed in the case 3.

The through-hole 51*b* is a square with four sides in the plane direction of the dial 52, and is larger than the flat antenna 11. These sides correspond 1:1 to the sides of the flat antenna 11. Vertically, the flat antenna 11 and drive mechanism 32 are located between the solar cell 51 and circuit board 43, and the flat antenna 11 is disposed inside the through-hole 51*b* in the plane direction of the dial 52.

More specifically, the electronic timepiece 200 is constructed so that microwave signals passing through the crystal 41, dial 52, and through-hole 51*b* are received by the flat antenna 11. Electrical energy produced by the solar cell 51 is stored in the storage battery 54.

Note that spacers for fastening other parts may also be disposed inside the case 3. The spacers are made from non-metallic materials that will not affect reception performance.

Information cannot be displayed on part of the face 52*a* if the solar cell 51 is disposed on the face 52*a* side of the dial 52, but this problem is avoided in this electronic timepiece 200 by disposing the solar cell 51 on the back 52*b* side of the dial 52. In addition, the flat antenna 11 will block light from reaching the solar cell 51 if the solar cell 51 is disposed between the flat antenna 11 and back cover 42, but this problem is avoided in this electronic timepiece 200 because the solar cell 51 is located between the dial 52 and the flat antenna 11.

Figure 4:
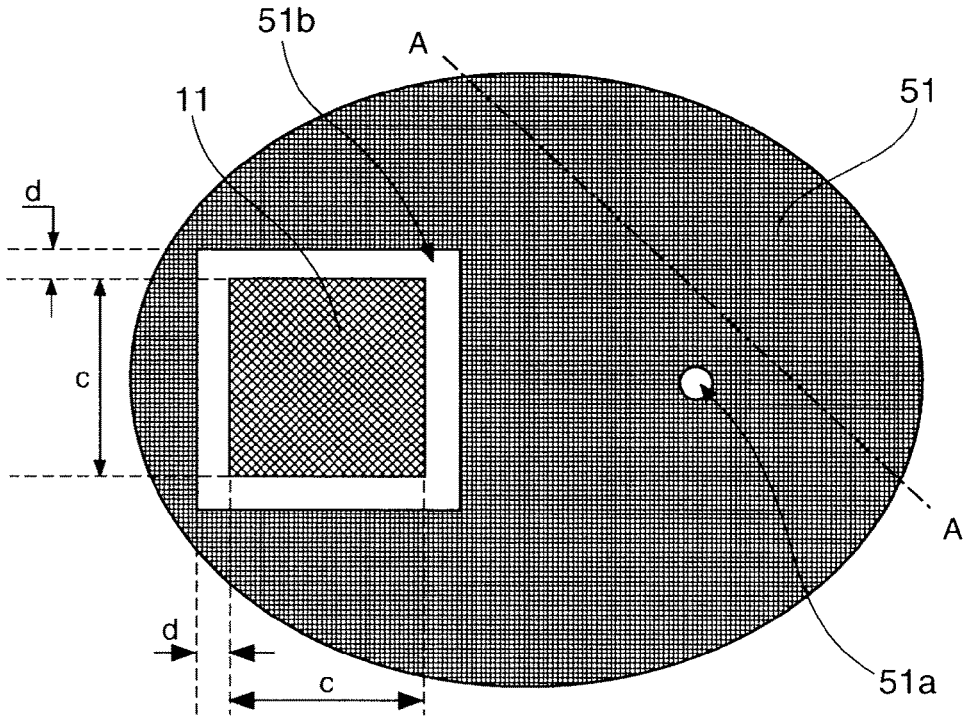
FIG. 4 shows the relative positions of the solar cell 51 and flat antenna 11 in the electronic timepiece 200.
Figure 5:
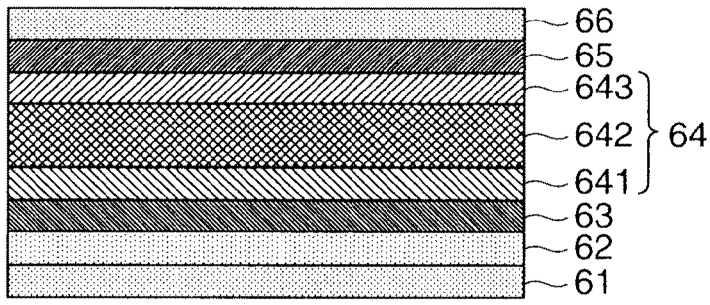
FIG. 5 is a section view of the solar cell 51 through line A-A in FIG. 4.

FIG. 4 shows the relative positions of the solar cell 51 and the flat antenna 11 in the plane direction of the dial 52, and FIG. 5 is a section view of the solar cell 51 through line A-A in FIG. 4. The top layers in FIG. 5 are the layers on the dial 52 side, and the bottom layers are layers on the circuit board 43 side. Layered in sequence from the bottom as shown in FIG. 5, the solar cell 51 includes a protective film 61, a film substrate 62, an electrode layer 63, an amorphous silicon (a-Si) layer 64, a transparent electrode layer 65, and a top protective film 66. The amorphous silicon layer 64 includes an n-type semiconductor layer 641 on the bottom, a p-type semiconductor layer 643 on the top, and an i-type semiconductor layer 642 therebetween.

When light passing through the dial 52, protective film 66 and transparent electrode layer 65 is incident to the p-type semiconductor layer 643, electrons and positive holes are generated in the i-type semiconductor layer 642. The resulting electrons and positive holes move respectively to the p-type semiconductor layer 643 and n-type semiconductor layer 641. As a result, current flows to an external circuit connected to the transparent electrode layer 65 and electrode layer 63, and the storage battery 54 is thereby charged.

The solar cell 51 thus has a strong microwave shielding effect because of the transparent electrode layer 65 and electrode layer 63 that include metallic materials. However, because the flat antenna 11 is disposed inside the through-hole 51*b* in the plane direction of the dial 52 in this electronic timepiece 200, the radiation pattern of the flat antenna 11 is substantially unobstructed vertically as shown in FIG. 3B. Part of the radiation pattern is, however, blocked by the solar cell 51.

Because the sensitivity of the flat antenna 11 increases and the satellite signal reception accuracy of the reception circuit 10 improves as the size of the radiation pattern increases, the obstructed portion of the radiation pattern is preferably as small as possible. Plane distance d is therefore provided between the flat antenna 11 and the solar cell 51 in the plane direction of the dial 52. This helps suppress loss due to electrical coupling between the flat antenna 11 electrodes and the solar cell 51 electrodes.

This plane distance d is the shortest distance in the plane direction of the dial 52 between the flat antenna 11 and the solar cell 51, and in this embodiment of the invention is the distance between corresponding sides.

Figure 6:
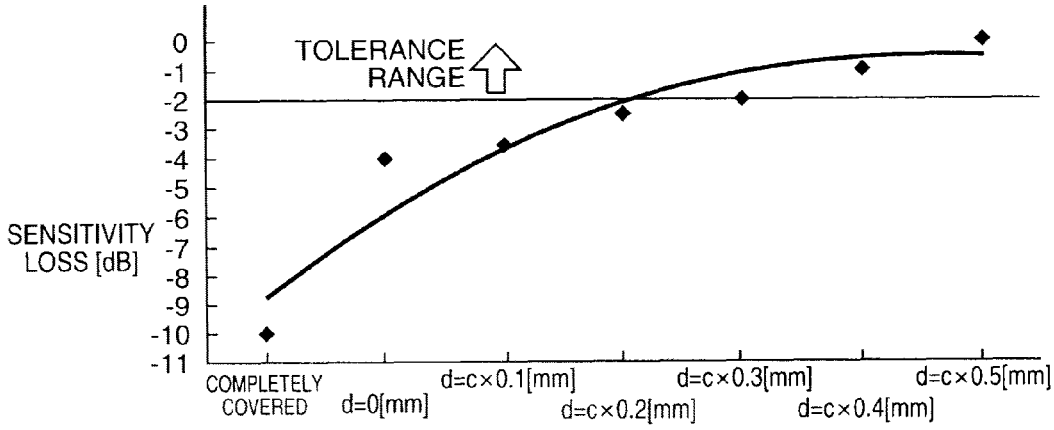
FIG. 6 is a graph showing the relationship between the sensitivity loss of the flat antenna 11 and plane distance d.

FIG. 6 shows the relationship between loss of sensitivity in the flat antenna 11 and this plane distance d when the vertical distance e between the flat antenna 11 and solar cell 51 is within 0.1 times the thickness f of the flat antenna 11. In FIG. 6, c is the length of a side (plane size) of the flat antenna 11, and the y-axis shows antenna sensitivity (dB) relative to the sensitivity when the plane distance d is infinite. As will be known from the figure, sensitivity loss decreases as the plane distance d increases relative to the plane size c, and is substantially zero (0) when 0.5 c<=d.

The reception circuit 10 is configured to enable receiving satellite signals with extremely high precision when the flat antenna 11 is used alone, and becomes unable to receive satellite signals with sufficiently high precision when the sensitivity loss of the flat antenna 11 exceeds a tolerance range. The sensitivity loss of the flat antenna 11 must therefore be kept within the tolerance range. To achieve this, 0.2 c<=d is required, and 0.5 c<=d is preferred, as will be known from FIG. 6.

However, if plane distance d is too long relative to plane size c, the size of the light-receiving area of the solar cell 51 decreases and power generation capacity may be insufficient. In this embodiment of the invention, therefore, d=0.2 c. More specifically, c=10 mm, and d=2 mm. If sufficient generating capacity can be assured, 0.5 c<=d is preferred.

As described above, this embodiment of the invention can suppress the sensitivity loss of the flat antenna 11 due to the solar cell 51 to a sufficiently low level. More specifically, because the electronic timepiece 200 can be driven by solar power and the sensitivity loss of the flat antenna 11 can be suppressed to a sufficiently low level, the electronic timepiece 200 can receive satellite signals and get the current time from GPS satellites 6.

Furthermore, because the shape of the flat antenna 11 in the plane direction of the dial 52 and the shape of the through-hole 51*b* in the plane direction of the dial 52 are similar to each other, the light-receiving area of the solar cell 51 is maximized and generating capacity is greatest. If considering the light-receiving area of the solar cell 51 is not necessary, this embodiment of the invention can be modified to use non-similar shapes.

For example, the side of the through-hole 51*b* with the shortest distance to the wall 31 in the plane direction of the dial 52 could be longer than any of the other sides, or it could curve along the wall 31.

Further alternatively, the distance between the 12:00 side of the flat antenna 11 and the corresponding side of the through-hole 51*b* could be increased, and the distance between the 6:00 side of the flat antenna 11 and the corresponding side of the through-hole 51*b* shortened. Further alternatively, the distance between the 3:00 side of the flat antenna 11 and the corresponding side of the through-hole 51*b* could be increased, and the distance between the 9:00 side of the flat antenna 11 and the corresponding side of the through-hole 51*b* could be decreased. These configurations make receiving signals from the 12:00 and 3:00 directions easier than receiving signals from the 6:00 and 9:00 directions.

As also described above, the electronic timepiece 200 is a wristwatch designed to be worn on the left wrist. Signals from the 9:00 direction are therefore more likely to be obstructed by the body than signals from the 3:00 direction. For example, when the user bends the left arm on which the electronic timepiece 200 is worn to see the face 52*a* of the dial 52, the user's left shoulder is located in the 9:00 direction of the face 52*a*, and signals from the 9:00 direction are easily blocked by the left shoulder or other body part. A configuration that can receive signals from the 3:00 direction more easily than from the 9:00 direction is therefore preferable in order to hold the actual sensitivity of the flat antenna high.

The electronic timepiece 200 according to this embodiment of the invention therefore renders the flat antenna 11 near the periphery of the storage area surrounded by the wall 31 in an area corresponding to the 9:00 position of the face 52*a*. More specifically, this embodiment of the invention uses a configuration that can receive signals from the 3:00 direction more easily than from the 9:00 direction, and the actual sensitivity of the flat antenna 11 is therefore high.

Furthermore, because the electronic timepiece 200 is a wristwatch and worn on the wrist, signals from the 6:00 direction are more likely to be blocked by the body than signals form the 12:00 direction. For example, when the user bends the left arm on which the electronic timepiece 200 is worn to see the face 52*a* of the dial 52, the user's body is located in the 6:00 direction of the face 52*a*, and signals from the 6:00 direction are easily blocked by the user's body. A configuration that can receive signals from the 12:00 direction more easily than from the 6:00 direction is therefore preferable in order to hold the actual sensitivity of the flat antenna high.

This embodiment of the invention can therefore be modified so that the flat antenna 11 is located near the periphery of the storage area surrounded by the wall 31 in an area corresponding to the 6:00 position of the face 52*a*. More specifically, the actual sensitivity of the flat antenna 11 can be kept high by using a configuration that can receive signals from the 12:00 direction more easily than from the 6:00 direction.

Furthermore, because the shape of the flat antenna 11 in the plane direction of the dial 52 is square, yield is improved in mass production of the electronic timepiece. Of course, if considering the yield is not necessary, this embodiment of the invention can be modified so that the shape of the flat antenna 11 in the plane direction of the dial 52 is a non-square rectangle or a non-rectangular polygon.

A case 3 made of plastic is used in this embodiment of the invention, but a metal case 3 could be used to create a luxurious appearance. An advantage of this configuration is that the case 3 is more scratch resistant. Examples of such metal cases 3 include cases made of stainless steel (SUS), cases made of other metals (such as titanium), and cases made of a combination of metallic and non-metallic materials. If a metal case 3 is used, however, flat antenna 11 sensitivity could be degraded by the wall 31. The relative positions of the flat antenna 11 and wall 31 must therefore be controlled to sufficiently suppress this less of sensitivity. This is described more specifically below.

As shown in FIG. 3A, the flat antenna 11 is square with four sides, and four rays that have one end at center 11*a* are perpendicular to the sides. Focusing on the ray 11*b* where the length between the side of the flat antenna 11 and the wall 31 is shortest, the distance between the side of the antenna and the wall 31 along this ray 11*b* is side distance b. More specifically, the shortest distance between the side of the flat antenna 11 and the wall 31 in the plane direction of the dial 52 is side distance b. As shown in FIG. 3B, the vertical distance between the top surface 31*a* of the wall 31 and the flat antenna 11 is antenna depth a. The wall 31 and flat antenna 11 are disposed relative to each other so that a<=b<=2*a*.

Figure 7:
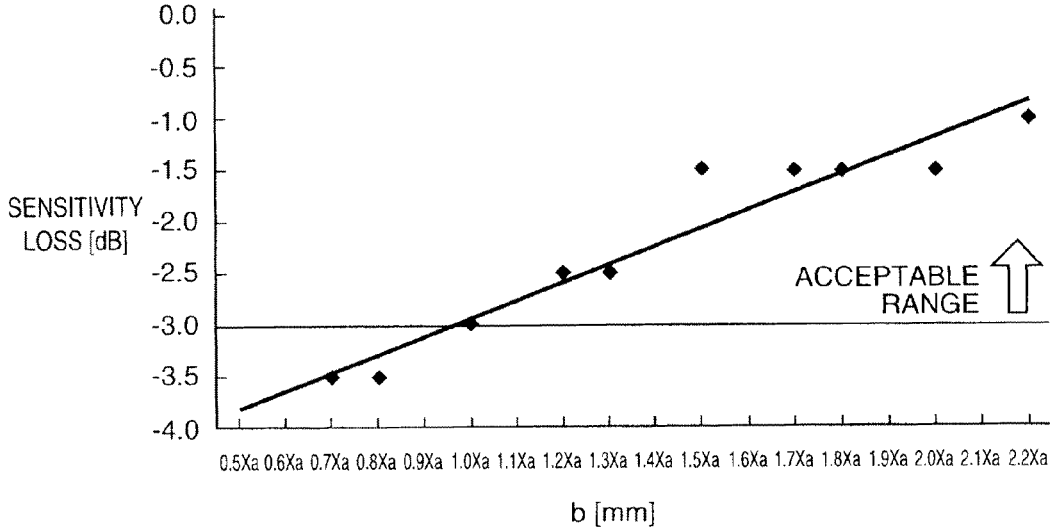
FIG. 7 is a graph showing the relationship between the sensitivity loss of the flat antenna 11 and side distance b.

FIG. 7 is a graph showing the relationship between the sensitivity loss of the flat antenna 11 and side distance b when the case 3 is made of stainless steel. In this graph the x-axis shows the side distance b relative to antenna depth a, and the y-axis shows sensitivity (dB) relative to the sensitivity when side distance b is infinite. As will be known from the figure, sensitivity loss decreases as the side distance b increases relative to antenna depth a.

As described above, because the reception circuit 10 becomes unable to receive satellite signals with sufficiently high accuracy when the sensitivity loss of the flat antenna 11 exceeds a tolerance range, the sensitivity loss of the flat antenna 11 must be kept within the tolerance range, and to achieve this a<=b is required as shown in FIG. 7. However, b cannot be increased unlimitedly because the size of the electronic timepiece 100 is limited. More specifically, b<=2*a* is required. This is why the wall 31 and flat antenna 11 are positioned relatively to each other so that a<=b<=2*a*. Note that a<=b<=2*a* is the same as 0.5 c<=b<=c.

A microstrip antenna is used as the flat antenna 11 in the embodiment described above, but a flat antenna other than a microstrip antenna may be used instead.

In addition, the foregoing embodiment of the invention obtains the time based on received signals and displays the obtained time, but the received signals may be used to acquire and display information other than the time. For example, information identifying the current location could be obtained and displayed based on the received signals.

The flat antenna 11 and reception circuit 10 in the foregoing embodiment are configured to receive signals from GPS satellites 6, but could receive signals from positioning information satellites other than GPS satellites 6, receive signals from satellites other than positioning information satellites, or receive signals from terrestrial stations.

An antenna that can receive signals in the ultrahigh frequency band (300 MHz-3 GHz) is used as the flat antenna 11 in the foregoing embodiment, but an antenna that can receive signals of a frequency higher than the ultrahigh frequency band may be used.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2010-152596, filed Jul. 5, 2010 is expressly incorporated by reference herein.

What is claimed is:

1. An electronic timepiece that receives radio frequency signals and displays information, comprising:

a dial on a front of the electronic timepiece and on which time is displayed, the dial having a surface defining a plane;

a flat antenna that is disposed in an area on a back side of the dial, parallel to the plane of the dial, and receives the radio frequency signals passing through the dial;

a photovoltaic device that is disposed vertically between the dial and the flat antenna, and is parallel to the dial and the flat antenna; and a hand that is disposed at a face side of the dial; wherein the flat antenna is not superimposed on the hand in plan view, the flat antenna is square in plan view, and when viewed in a plan view, the shortest distance between a side of the flat antenna and a parallel facing edge of a through hole of the photovoltaic device is at least 0.2 times a length of the side of the flat antenna.

2. The electronic timepiece described in claim 1, wherein:

the flat antenna is a microstrip antenna.

3. The electronic timepiece described in claim 1, wherein:

the gap between the flat antenna and the photovoltaic device in the vertical direction is less than or equal to 0.1 time the thickness of the flat antenna.

4. The electronic timepiece described in claim 1, wherein:

the photovoltaic device has a through-hole in which the flat antenna is contained; and the shape of the flat antenna and the shape of the through-hole in plan view are similar to each other.

5. The electronic timepiece described in claim 1, further comprising:

a metal case that has a wall defining a space in which the dial, the flat antenna, and the photovoltaic device are housed;

wherein the wall has a top surface on a front side of the electronic timepiece and a bottom surface on a back side of the electronic timepiece, and the flat antenna and the case are disposed so that a side distance between a side of the flat antenna and the wall is greater than or equal to one time and less than or equal to two times a vertical distance between the top surface of the wall and the flat antenna.

6. The electronic timepiece described in claim 1, further comprising:

a case that has a wall defining a space in which the dial, the flat antenna, and the photovoltaic device are housed;

wherein the flat antenna is disposed in a peripheral part of the space corresponding to the 9:00 or 6:00 position on the front side.

7. The electronic timepiece described in claim 1, wherein:

the signals are satellite signals transmitted from positioning information satellites; and the electronic timepiece includes a time acquisition unit that acquires time based on the satellite signals.

* * * * *